US005463785A

United States Patent [19]

McKeel

[11] Patent Number: 5,463,785

[45] Date of Patent: Nov. 7, 1995

[54] COMBINATION AIRFLOW INFANT PAD AND TODDLER PILLOW

[76] Inventor: William H. McKeel, Rte. 6 Box 595A, Springfield, Mo. 65803

[21] Appl. No.: 266,133

[22] Filed: Jun. 27, 1994

[51] Int. Cl.[6] ..... A47C 27/14; A47C 27/00

[52] U.S. Cl. ..... 5/655; 5/468

[58] Field of Search ..... 5/468, 655, 484, 5/481, 469, 900.5, 636

[56] References Cited

U.S. PATENT DOCUMENTS

| | | | |
|---|---|---|---|
| 3,209,380 | 10/1965 | Watsky | 5/468 |
| 4,070,719 | 1/1978 | Morgan | 5/468 |
| 4,686,722 | 8/1987 | Swart | 5/453 |
| 4,980,940 | 1/1991 | Isshiki | 5/468 |
| 5,109,560 | 5/1992 | Uetake | 5/453 |
| 5,226,188 | 7/1993 | Lion | 5/653 |
| 5,325,552 | 7/1994 | Fong | 5/468 |

FOREIGN PATENT DOCUMENTS

| | | | |
|---|---|---|---|
| 3017379 | 11/1981 | Germany | 5/481 |

*Primary Examiner*—Alexander Grosz
*Attorney, Agent, or Firm*—Richard J. Grundstrom

[57] ABSTRACT

A combination airflow infant pad and toddler pillow basically consisting of a pad having a top and bottom with side edges and end edges. The pad has a plurality of horizontal air channels extending across the surface. Another set of a plurality of air channels run perpendicular to and intersect with the horizontal air channels. A plurality of air holes are provide through the pad at the intersections of the horizontal air channels and the perpendicular air channels.

The channels and holes allow air flow around an infant sleeping on the pad. Any spilled liquid will run down the channels and through the holes to keep the baby dry. The entire pad can be made in various sizes. In the preferred embodiment, the size will fit a standard bassinet. The pad can also be used as a toddler's pillow, as the baby grows.

4 Claims, 4 Drawing Sheets

COMBINATION AIRFLOW INFANT PAD AND TODDLER PILLOW

BACKGROUND OF THE INVENTION

The present invention relates to a combination airflow infant pad and toddler pillow and more particularly to a pad having air channels to provide for increased air circulation to an infant or toddler using the pad and for runoff of any liquids or moisture.

There are several different kinds of bedding materials in use today. There are the typical mattresses, water beds, air mattresses and pads of various nature. They all have certain advantages and disadvantages for the particular application. Each individual has his own preferences. This invention pertains to pads used as a mattress for infants that can also be used as a pillow for toddlers.

Pads for infants come in many different designs. One of the most common pads is a foam pad covered with cloth, plastic or a vinyl material. The cover can usually be removed for washing. The infant using such a pad as a mattress lays upon the pad. A sheet may or may not be used.

The pad, whether covered or not, does not allow air flow between the infant and the pad. The lack of air flow creates a condition that cause the infant to perspire at a greater rate. Pajamas, other clothing and bed covers may help to reduce the sweating. The bedding or pad cover, in the case where a covered pad is being used, typically absorbs the perspiration, saliva, or leakage from a bottle. As a result, the infant is often laying on a damp or wet bed.

Other combination of mattresses, blankets and other bedding materials may be soft and comfortable. The combinations may be suitable for older children and adults, but it may not be safe for infants. The U.S. Consumer Product Safety Commission has reported that soft and fuzzy bedding may be lethal to an infant. They have warned parents that infants sleeping face down may die of continually breathing their own exhaled breath. Research has suggested that up to 25 percent of SIDs may be caused by soft bedding. The use of flat firm mattresses is being encouraged.

Accordingly, it is an object of the present invention to provide a combination airflow infant pad and toddler pillow adapted to provide an increased air flow to the infant using the pad as a mattress and to the toddler's face who is using the pad for a pillow.

Another object of the present invention is to provide an improved combination airflow infant pad and toddler pillow constructed to provide a means of allowing saliva, bottle leakage, urine and any other liquids to runoff the sleeping surface of the pad.

A further object of the present invention is to provide a combination airflow infant pad and toddler pillow adapted for keeping the infant or toddler dryer to increase the infant's or toddler's comfort. The increased air flow under the toddler or infant and the ability to allow liquids to runoff accomplishes this objective.

Still another object of the present invention is to provide a combination airflow infant pad and toddler pillow that may be used as an infant bedding pad for a bassinet or crib and later used as a pillow as the infant turns toddler.

Still a further object of the present invention is to provide a combination airflow infant pad and toddler pillow that provides a flat firm mattress that gives necessary support and comfort for an infant and toddler.

Another object of the present invention is to provide a combination airflow infant pad and toddler pillow that can be folded and fitted into a diaper bag.

SUMMARY OF THE INVENTION

To accomplish these and other objects of this invention there is provided a combination airflow infant pad and toddler pillow. The combination airflow infant pad and toddler pillow consists of a pad having a top and bottom with side edges and end edges. The pad has a plurality of horizontal air channels extending across the surface. Another set of air channels runs perpendicular to and intersect with the horizontal air channels. A plurality of air holes is provided through the pad at the intersections of the horizontal air channels and the perpendicular air channels.

The combination airflow infant pad and toddler pillow of this invention is typically made of a water impermeable closed cell polyethylene foam. The horizontal air channels run parallel to each other the entire length of the pad in a spaced relationship. The vertical channels run perpendicular to the horizontal channels in a spaced relationship and parallel to the side edges. Holes are punched through the pad at every other point of intersection of the horizontal and vertical channels. The channels and holes allow air flow around a baby sleeping on the pad. Any spilled liquid also runs down the channels and through the holes to keep the baby dry. The entire pad can be made in various sizes. In the preferred embodiment, the size will fit a standard bassinet.

The above mentioned and other objects and features of the present invention will be better understood and appreciated from the following detailed description of the main embodiment thereof, selected for purposes of illustration and shown in the accompanying drawings.

DETAILED DESCRIPTION

Figure 3:
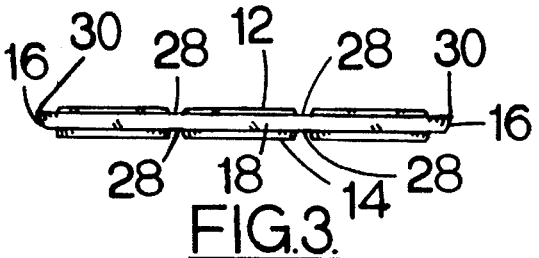
FIG. 3 is an end view of the combination airflow infant pad and toddler pillow.

Referring now to the drawings, in general, there is shown one preferred embodiment for the combination airflow infant pad and toddler pillow.

Figure 1:
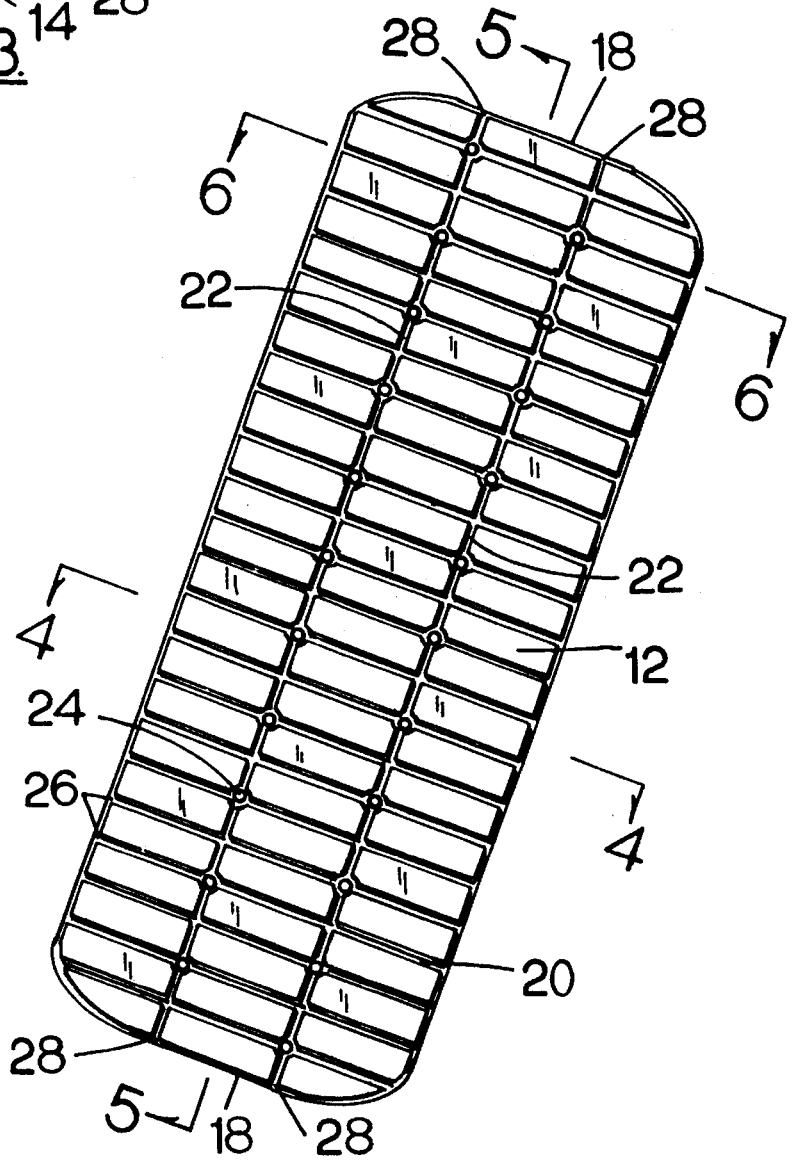
FIG. 1 is an isometric view of the combination airflow infant pad and toddler pillow.

Referring to FIG. 1, the combination airflow infant pad and toddler pillow basically consists of a pad 10 having a top 12 and bottom 14 with side edges 16 and end edges 18. The pad has a plurality of horizontal air channels 20 extending across the surface. Another set of a plurality of air channels 22 run perpendicular to and intersect with the horizontal air channels 20. A plurality of air holes 24 are provided through the pad 10 at the intersections of the horizontal air channels 20 and the perpendicular air channels 22.

The preferred embodiment and the best mode contemplated of the combination airflow infant pad and toddler pillow 10 of the present invention are herein described. However, it should be understood that the best mode for carrying out the invention hereinafter described is offered by way of illustration and not by the way of limitation. It is intended that the scope of the invention includes all modifications that incorporate its principal design features.

The pad 10 has a top surface 12, bottom surface 14, side edges 16 and end edges 18. The pad 10 is made with a water impermeable material. In the preferred embodiment, the water impermeable pad 10 is constructed from a cross link closed cell polyethylene foam. Any other water impermeable material having similar characteristics could also be used without departing from the scope and spirit of the invention. The pad 10 should be compressible to conform to the shape of the infant to provide comfort and support. The material should also return to the precompression shape when the infant shifts his weight or is removed from the pad 10. Since the pad 10 will be used by an infant and toddlers, the material of which the pad is made should be fire retardant, non toxic and FDA approved.

The pad 10 can be made by molding, such as by injection molding, or any other manufacturing process known in the art. In the preferred embodiment and best mode contemplated, the pad 10 will be rectangular, 12 inches wide, 29 inches long and ¾ of an inch thick. All four corners are rounded or formed with two inch radius quarter circles. These dimensions correspond to a standard size pad for a bassinet. Other dimensions, shapes and size could also be made, as the need arises, without departing from the scope and spirit of the invention as claimed.

The pad 10 may also have upturned edges 30. These are best seen on FIG. 3. The upturned edges 30 extend upward from the top surface 12 at the outer edges 16. Upturned edges 30 forms a boundary to help maintain an infant on the pad 10.

Figure 2:
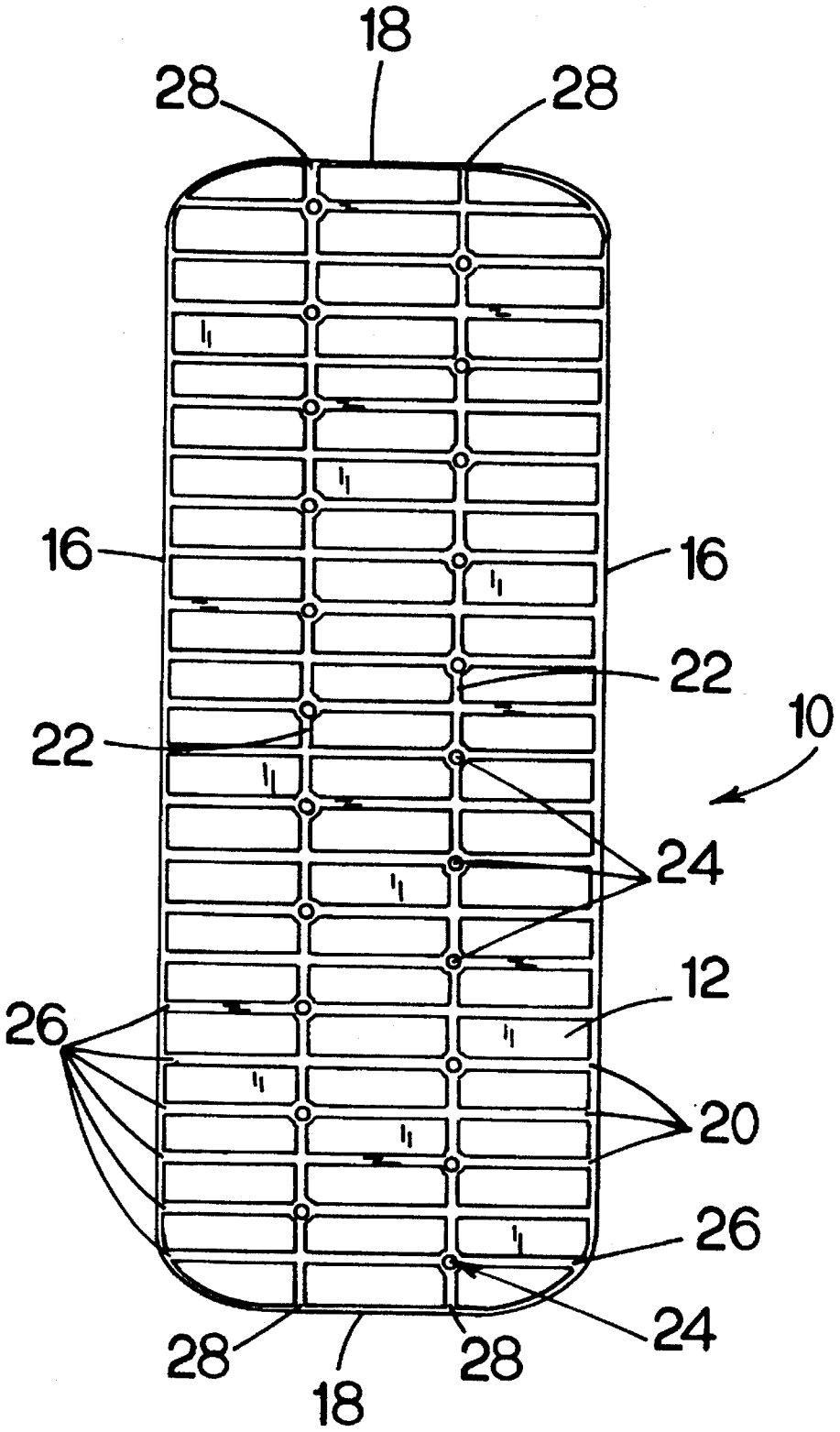
FIG. 2 is a top view of the combination airflow infant pad and toddler pillow.
Figure 4:
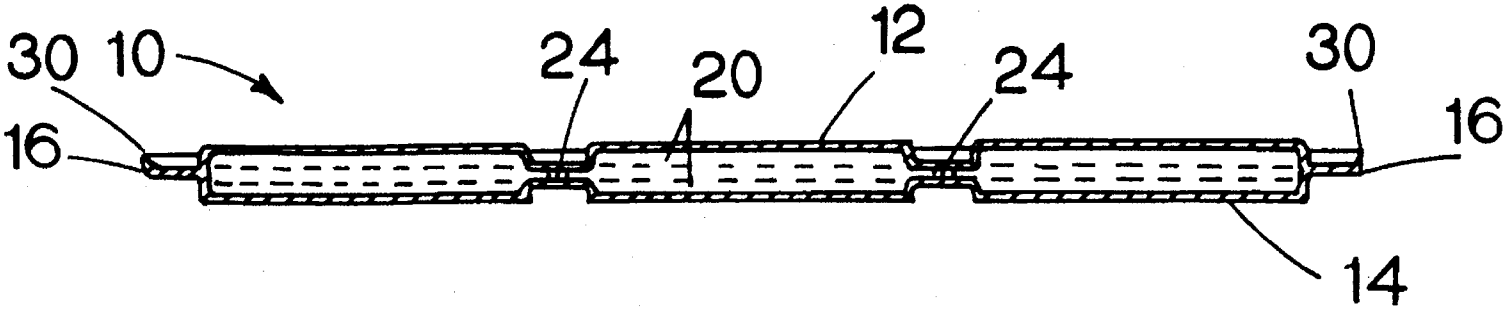
FIG. 4 is a cross sectional view across the width of the combination airflow infant pad and toddler pillow.
Figure 5:
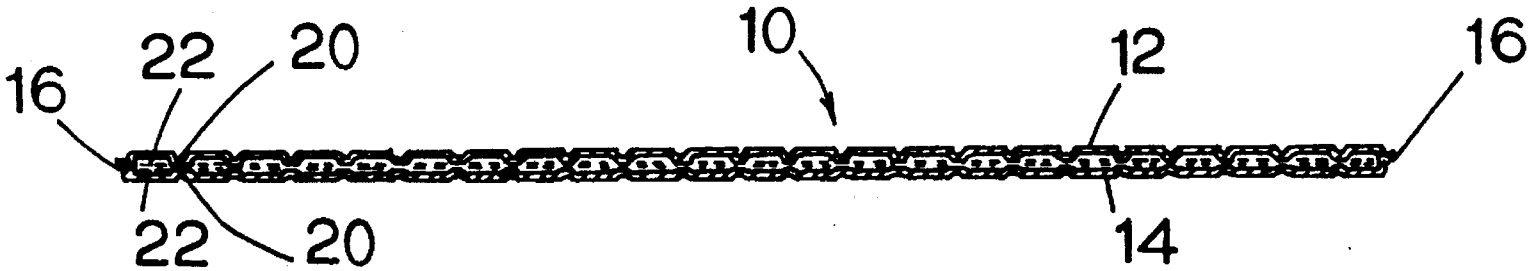
FIG. 5 is a cross sectional view across the length of the combination airflow infant pad and toddler pillow.
Figure 6:
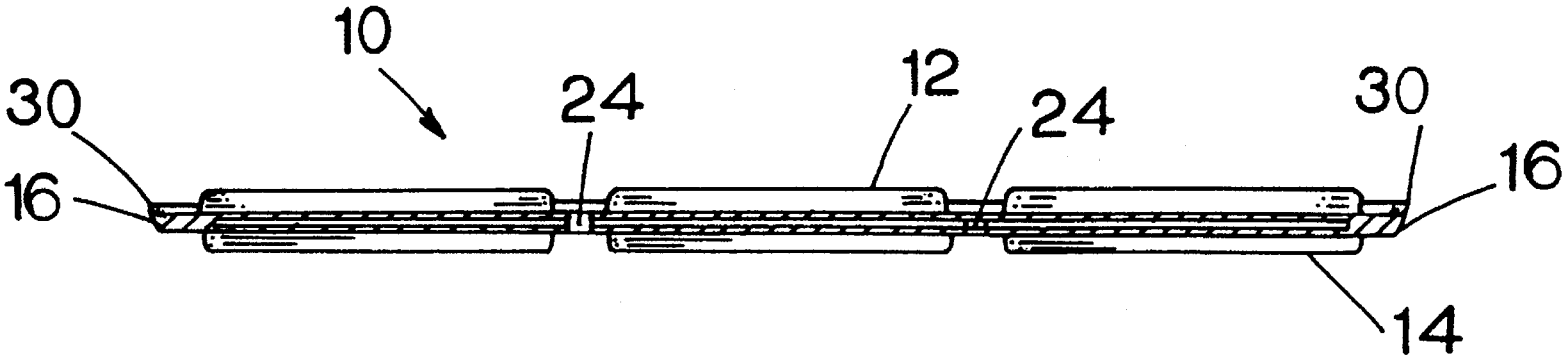
FIG. 6 is a cross sectional view.

The pad 10 has a plurality of horizontal air channels 20 extending across the surface. Referring to FIG. 2. The horizontal air channels 20 will be parallel to each other and to the end edges 18 in the preferred embodiment. They are also in a parallel spaced relationship to each other. In the preferred embodiment, the plurality of horizontal air channels 20 are located directly opposite and in line with each other on both the top 12 and the bottom 14 of the pad 10. Both the top surface 12 and bottom surface 14 being identical. However, there could be applications where the horizontal air channels 20 are only on one side.

The horizontal air channels 20, in the best mode contemplated, will be approximately ¼ of an inch wide, 5/16 of an inch deep and located every one inch on center for the entire length of the pad 10. When the horizontal air channels 20 are included on both sides, the air channels 20 will be located directly opposite of each other, back to back. In this embodiment, using the dimensions given above, the thickness of the pad 10 between the bottom of the air channels 20 on the top surface 12 and bottom surface 14 will be approximately ⅛ of an inch.

A second set of air channels 22 run perpendicular to and intersect with the horizontal air channels 22. FIG. 2. The perpendicular air channels 22 generally have the same width and depth as the horizontal air channels 20. In the preferred embodiment, the plurality of perpendicular air channels 22 consist of two perpendicular air channels 22 on the top 12 of the pad 10 and two perpendicular air channels 22 on the bottom 14 of the pad 10. The perpendicular air channels 22 will be in a parallel spaced relationship to each other and to the side edges 16 of the pad 10.

In the best mode contemplated, the perpendicular air channels 22 will be located approximately 3 inches inward from the side edges 16. The width of the air channels 22 being ¼ of an inch and the width of the pad 10 being 12 inches, leaves the two perpendicular air channel 22 separated by approximately 5½ inches. The perpendicular air channels 22 will run the entire length of the pad 10.

The ends 26 of the horizontal air channels 20 and the ends 28 of the perpendicular air channel 22 will extend to the side edges 16 and the end edges 18. The ends 26 and 28 are left open at the edges 12 and 14 to allow air to enter and exit. The design and object are to allow more air flow through the air channels 20 and 22 and under the infant.

A plurality of air holes 24 are provided through the pad 10 at the intersections of the horizontal air channels 20 and the perpendicular air channels 22. In the preferred embodiment, the air holes 24 are made at every other intersection of the horizontal air channels 20 and the perpendicular air channels 22. The holes 24 typically have, but not necessarily, a diameter equal to the width of the air channels 20 and 22. In the embodiment herein described, the diameter would be ¼ of an inch. This dimension corresponds to the width of the horizontal and perpendicular air channels, 20 and 22. The holes 24 can be bored, drilled, punched or made during the manufacturing process. The idea behind the holes 10 are to ensure the air flow is not impeded.

The horizontal air channels 20, perpendicular air channels 22 and holes 24 are also designed to provide runoff of any liquids around the infant, besides providing air flow. This is also the reason for making the pad 10 from a water impermeable material. The liquids could be from bottle leakage, perspiration or it could be the baby's urine. The air channels 20 and 22 and holes 24 allow runoff of liquids. The increased air flow and liquid runoff will help keep the infant dryer, cleaner and help to reduce skin irritation.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A combination airflow infant pad and toddler pillow with the dimensions generally of a standard sized pad for an infant's bassinet or the like, comprised of a water impermeable closed cell foam of about ¾ of an inch thickness, comprising:

a generally rectangular pad with generally identical top and bottom surfaces and side edges and end edges;

a plurality of horizontal, lateral air channels extending on the top and bottom surfaces, between said side edges;

a plurality of horizontal, longitudinal air channels extending on the top and bottom surfaces, perpendicular to and intersecting said lateral air channels, and extending between said end edges; and a plurality of air holes through said pad located at intersections of said lateral and longitudinal air channels, said air holes permitting fluid drainage and air circulation between the top and bottom surfaces.

2. The combination airflow infant pad and toddler pillow as set forth in claim 1 in which the lateral air channels are parallel to each other and to the end edges of the pad, and the longitudinal air channels are parallel to each other, and to the side edges of the pad.

3. The combination airflow infant pad and toddler pillow as set forth in claim 1, comprising two longitudinal air channels on the top and on the bottom surfaces of the pad.

4. The combination airflow infant pad and toddler pillow as set forth in claim 1 in which said pad is constructed from a polyethylene foam.

* * * * *